US011064296B2

(12) United States Patent
Wang et al.

(10) Patent No.: US 11,064,296 B2
(45) Date of Patent: Jul. 13, 2021

(54) VOICE DENOISING METHOD AND APPARATUS, SERVER AND STORAGE MEDIUM

(71) Applicant: IFLYTEK CO., LTD., Anhui (CN)

(72) Inventors: Haikun Wang, Anhui (CN); Feng Ma, Anhui (CN); Zhiguo Wang, Anhui (CN)

(73) Assignee: IFLYTEK CO., LTD., Anhui (CN)

( * ) Notice: Subject to any disclaimer, the term of this patent is extended or adjusted under 35 U.S.C. 154(b) by 0 days.

(21) Appl. No.: 16/769,444

(22) PCT Filed: Jun. 15, 2018

(86) PCT No.: PCT/CN2018/091459
§ 371 (c)(1),
(2) Date: Jun. 3, 2020

(87) PCT Pub. No.: WO2019/128140
PCT Pub. Date: Jul. 4, 2019

(65) Prior Publication Data

US 2020/0389728 A1 Dec. 10, 2020

(30) Foreign Application Priority Data

Dec. 28, 2017 (CN) ..... 201711458315.0

(51) Int. Cl.
*H04R 3/04* (2006.01)
*G10L 21/0232* (2013.01)
(Continued)

(52) U.S. Cl.
CPC ..... *H04R 3/04* (2013.01); *G10L 21/0232* (2013.01); *G10L 25/78* (2013.01); *G10L 2021/02163* (2013.01); *G10L 2025/783* (2013.01)

(58) Field of Classification Search
CPC ..... H04R 3/04; H04R 3/005; H04R 1/406; H04R 3/002; H04R 1/1083;
(Continued)

(56) References Cited

U.S. PATENT DOCUMENTS 6,006,175 A * 12/1999 Holzrichter ..... A61B 5/0507 704/205
9,311,928 B1 4/2016 Avargel et al.
(Continued)

FOREIGN PATENT DOCUMENTS

CN 1750123 A 3/2006
CN 101510905 A 8/2009
(Continued)

OTHER PUBLICATIONS

International Search Report and the Written Opinion issued in PCT/CN2018/091459 dated Sep. 21, 2018, 22 pages.
(Continued)

*Primary Examiner* — Akelaw Teshale
(74) *Attorney, Agent, or Firm* — Zhong Law, LLC

(57) ABSTRACT

Provided are a voice denoising method and apparatus, a server and a storage medium. The voice denoising method comprises: acquiring voice signals synchronously collected by an acoustic microphone and a non-acoustic microphone (S100); carrying out voice activity detection according to the voice signal collected by the non-acoustic microphone to obtain a voice activity detection result (S110); and according to the voice activity detection result, denoising the voice signal collected by the acoustic microphone to obtain a denoised voice signal (S120). The effect of denoising can be enhanced, and the quality of voice signals can be improved.

20 Claims, 10 Drawing Sheets

(51) Int. Cl.
*G10L 25/78* (2013.01)
*G10L 21/0216* (2013.01)

(58) Field of Classification Search
CPC ..... H04R 2410/07; H04R 3/02; H04R 1/08; H04R 29/004; H04R 2410/05; H04R 1/26; H04R 25/353; H04R 25/604; H04R 2410/01; H04R 29/006; G10L 21/0232; G10L 25/78; G10L 2021/02163; G10L 2025/783; G10L 2021/02165; G10L 21/003; G10L 21/0216; G10L 21/0208; G10L 25/93; G10L 21/0364; G10L 2021/02166; G10L 25/84; G10L 15/28; G10L 2021/02085; G10L 15/24; G10L 13/04; G10L 2025/937
See application file for complete search history.

(56) References Cited

U.S. PATENT DOCUMENTS

| | | | | |
|---|---|---|---|---|
| 9,418,675 | B2 | 8/2016 | Zhu et al. | |
| 2001/0021905 | A1 | 9/2001 | Burnett et al. | |
| 2002/0198705 | A1* | 12/2002 | Burnett | G10L 25/93 704/214 |
| 2004/0133421 | A1* | 7/2004 | Burnett | G10L 21/0308 704/215 |
| 2005/0114124 | A1 | 5/2005 | Liu et al. | |
| 2005/0185813 | A1 | 8/2005 | Sinclair et al. | |
| 2006/0072767 | A1 | 4/2006 | Zhang et al. | |
| 2007/0233479 | A1* | 10/2007 | Burnett | G10L 25/93 704/233 |
| 2010/0278352 | A1* | 11/2010 | Petit | H04R 3/005 381/71.1 |
| 2011/0026722 | A1* | 2/2011 | Jing | G10L 25/84 381/71.1 |
| 2012/0209603 | A1* | 8/2012 | Jing | G10L 21/0364 704/233 |
| 2013/0024194 | A1 | 1/2013 | Zhao et al. | |
| 2013/0246062 | A1 | 9/2013 | Avargel et al. | |
| 2013/0343558 | A1* | 12/2013 | Fox | H04R 3/002 381/71.14 |
| 2014/0126743 | A1* | 5/2014 | Petit | H04R 3/005 381/92 |
| 2017/0111734 | A1 | 4/2017 | Macours | |
| 2018/0226086 | A1 | 8/2018 | Huang et al. | |

FOREIGN PATENT DOCUMENTS

| | | | | |
|---|---|---|---|---|
| CN | 101887728 | A | 11/2010 | |
| CN | 102411936 | A | 4/2012 | |
| CN | 103208291 | A | 7/2013 | |
| CN | 203165457 | U | 8/2013 | |
| CN | 104091592 | A | 10/2014 | |
| CN | 105940445 | A | 9/2016 | |
| CN | 106101351 | A | 11/2016 | |
| CN | 106686494 | A | * 12/2016 | G10L 21/0216 |
| CN | 106686494 | A | 5/2017 | |
| CN | 106952653 | A | 7/2017 | |
| CN | 106970772 | A | 7/2017 | |
| CN | 107004424 | A | 8/2017 | |
| CN | 107093429 | A | 8/2017 | |
| CN | 107910011 | A | 4/2018 | |
| EP | 2151821 | A1 | 2/2010 | |
| JP | H03241400 | A | 10/1991 | |
| JP | H03274098 | A | 12/1991 | |
| JP | 2002537585 | A | 11/2002 | |
| WO | 2017017568 | A1 | 2/2017 | |

OTHER PUBLICATIONS

Japanese Office Action issued in Japanese Application No. 2020-528147 dated May 25, 2021, 8 pages.

* cited by examiner

VOICE DENOISING METHOD AND APPARATUS, SERVER AND STORAGE MEDIUM

TECHNICAL FIELD

This application is the national phase of International Application No. PCT/CN2018/091459, titled "VOICE DENOISING METHOD AND APPARATUS, SERVER AND STORAGE MEDIUM", filed on Jun. 15, 2018, which claims the priority to Chinese Patent Application No. 201711458315.0, titled "METHOD AND APPARATUS FOR SPEECH NOISE REDUCTION, SERVER, AND STORAGE MEDIUM", filed on Dec. 28, 2017 with the China National Intellectual Property Administration, both of which are incorporated herein by reference in their entirety.

BACKGROUND

With its rapid development, the speech technology has been widely adopted in various applications of daily life and work, providing great convenience for people.

When applying the speech technology, the quality of speech signals is generally decreased by interference factors such as the noise. Degradation of the quality of speech signals can directly affect applications (for example, speech recognition and speech broadcast) of the speech signals. Therefore, it is an immediate need to improve the quality of speech signals.

SUMMARY

In order to address the above technical issue, a method for speech noise reduction, an apparatus for speech noise reduction, a server, and a storage medium are provided according to embodiments of the present disclosure, so as to improve quality of speech signals. The technical solutions are provided as follows.

A method for speech noise reduction is provided, including:

obtaining a speech signal collected by an acoustic microphone and a speech signal collected by a non-acoustic microphone, where the speech signals are simultaneously collected;

detecting speech activity based on the speech signal collected by the non-acoustic microphone, to obtain a result of speech activity detection; and denoising the speech signal collected by the acoustic microphone based on the result of speech activity detection, to obtain a denoised speech signal.

An apparatus for speech noise reduction, includes:

a speech signal obtaining module, configured to obtain a speech signal collected by an acoustic microphone and a speech signal collected by a non-acoustic microphone, where the speech signals are simultaneously collected;

a speech activity detecting module, configured to detect speech activity based on the speech signal collected by the non-acoustic microphone, to obtain a result of speech activity detection; and a speech denoising module, configured to denoise the speech signal collected by the acoustic microphone based on the result of speech activity detection, to obtain a denoised speech signal.

A server is provided, including at least one memory and at least one processor, where the at least one memory stores a program, the at least one processor invokes the program stored in the memory, and the program is configured to perform:

obtaining a speech signal collected by an acoustic microphone and a speech signal collected by a non-acoustic microphone, where the speech signals are simultaneously collected;

detecting speech activity based on the speech signal collected by the non-acoustic microphone, to obtain a result of speech activity detection; and denoising the speech signal collected by the acoustic microphone based on the result of speech activity detection, to obtain a denoised speech signal.

A storage medium is provided, storing a computer program, where the computer program when executed by a processor performs each step of the aforementioned method for speech noise reduction.

Compared with conventional technology, beneficial effects of the present disclosure are as follows.

In embodiments of the present disclosure, the speech signals simultaneously collected by the acoustic microphone and the non-acoustic microphone are obtained. The non-acoustic microphone is capable of collecting a speech signal in a manner independent from ambient noise (for example, by detecting vibration of human skin or vibration of human throat bones). Thereby, speech activity detection based on the speech signal collected by the non-acoustic microphone can reduce an influence of the ambient noise and improve detection accuracy, in comparison with that based on the speech signal collected by the acoustic microphone. The speech signal collected by the acoustic microphone is denoised based on the result of speech activity detection, and such result is obtained from the speech signal collected by the non-acoustic microphone. An effect of noise reduction is enhanced, a quality of the denoised speech signal is improved, and a high-quality speech signal can be provided for subsequent application of the speech signal.

BRIEF DESCRIPTION OF THE DRAWINGS

For clearer illustration of the technical solutions according to embodiments of the present disclosure or conventional techniques, hereinafter are briefly described the drawings to be applied in embodiments of the present disclosure or conventional techniques. Apparently, the drawings in the following descriptions are only some embodiments of the present disclosure, and other drawings may be obtained by those skilled in the art based on the provided drawings without creative efforts.

DETAILED DESCRIPTION OF THE EMBODIMENTS

Figure 1:
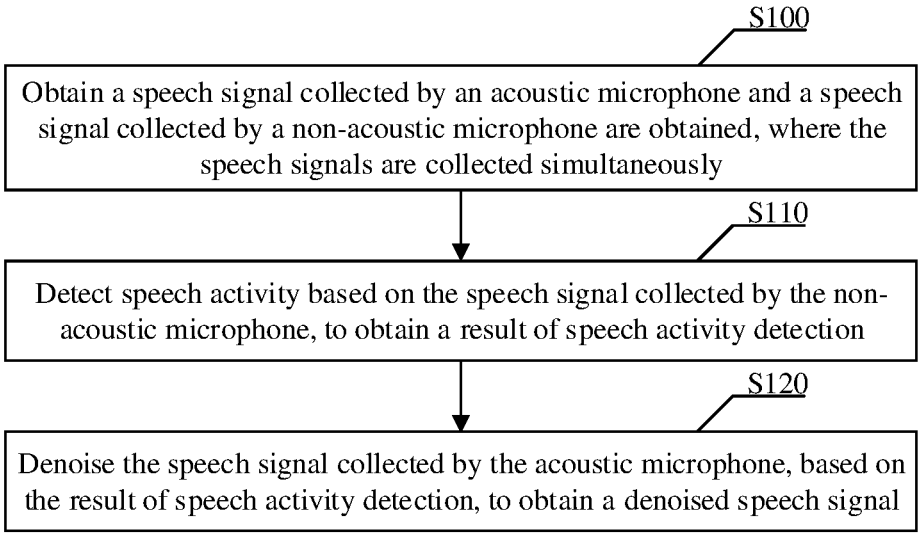
FIG. 1 is a flow chart of a method for speech noise reduction according to an embodiment of the present disclosure.

Hereinafter technical solutions in embodiments of the present disclosure are described clearly and completely in conjunction with the drawings in embodiments of the present closure. Apparently, the described embodiments are only some rather than all of the embodiments of the present disclosure. Any other embodiments obtained based on the embodiments of the present disclosure by those skilled in the art without any creative effort fall within the scope of protection of the present disclosure.

Hereinafter the construction of speech noise reduction methods according to embodiments of the present disclosure is briefly described, before introducing the method for speech noise reduction.

In conventional technology, quality of a speech signal may be improved through speech noise reduction techniques to enhance a speech and improve speech recognition rate. Conventional speech noise reduction techniques may include speech noise reduction methods based on a single microphone, and speech noise reduction methods based on a microphone array.

The methods for speech noise reduction based on the single microphone take into consideration statistical characteristics of noise and a speech signal to achieve a good effect in suppressing stationary noise. However, it cannot predict non-stationary noise with an unstable statistical characteristic, thus resulting in a certain degree of speech distortion. Therefore, the method based on the single microphone has a limited capability in speech noise reduction.

The methods for speech noise reduction based on the microphone array fuse temporal information and spatial information of a speech signal. Such method can achieve a better balance between the level of noise suppression and control on speech distortion, and achieve a certain level of suppressing non-stationary noise, in comparison with the method based on the single microphone that merely applies temporal information of a signal. Nevertheless, it is impossible to apply an unlimited number of microphones in some application scenarios due to the limitation on the cost and size of devices. Therefore, a satisfactory noise reduction cannot be achieved even if the speech noise reduction is based on the microphone array.

In view of the above issues in methods of speech noise reduction based on the single microphone and the microphone array, a signal collection device unrelated to ambient noise (hereinafter referred to as a non-acoustic microphone, such as a bone conduction microphone or an optical microphone), instead of an acoustic microphone (such as a single microphone or a microphone array), is adopted to collect a speech signal in a manner unrelated to ambient noise (for example, the bone conduction microphone is pressed against a facial bone or a throat bone detects vibration of the bone, and converts the vibration into a speech signal; or, the optical microphone also called a laser microphone emits a laser onto a throat skin or a facial skin via a laser emitter, receives a reflected signal caused by skin vibration via a receiver, analyzes a difference between the emitted laser and the reflected laser, and converts the difference into a speech signal), thereby greatly reducing the noise-generated interference on speech communication or speech recognition.

The non-acoustic microphone also has limitations. Since a frequency of vibration of the bone or the skin cannot be high enough, an upper limit in frequency of a signal collected by the non-acoustic microphone is not high, generally no more than 2000 Hz. Because the vocal cord vibrates only in a voiced sound, and does not vibrate in an unvoiced sound, the non-acoustic microphone is only capable to collect a signal of the voiced sound. A speech signal collected by the non-acoustic microphone is incomplete although with good noise immunity, and the non-acoustic microphone alone cannot meet a requirement on speech communication and speech recognition in most scenarios. In view of the above, a method for speech noise reduction is provided as follows. Speech signals that are simultaneously collected by an acoustic microphone and a non-acoustic microphone simultaneously are obtained. Speech activity is detected based on the speech signal collected by the non-acoustic microphone, to obtain a result of speech activity detection. The speech signal collected by the acoustic microphone is denoised based on the result of speech activity detection, to obtain a denoised speech signal. Thereby, speech noise reduction is achieved.

Hereinafter introduced is a method for speech noise reduction according to an embodiment of the present disclosure. Referring to FIG. 1, the method includes steps S100 to S120.

In step S100, a speech signal collected by an acoustic microphone and a speech signal collected by a non-acoustic microphone are obtained, where the speech signals are collected simultaneously.

In one embodiment, the acoustic microphone may include a single acoustic microphone or an acoustic microphone array.

The acoustic microphone may be placed at any position where a speech signal can be collected, so as to collect the speech signal. It is necessary to place the non-acoustic microphone in a region where the speech signal can be collected (for example, it is necessary to press a bone-conduction microphone against a throat bone or a facial bone, and it is necessary to place an optical microphone at a position where a laser can reach a skin vibration region (such as a side face or a throat) of a speaker), so as to collect the speech signal.

Since the acoustic microphone and the non-acoustic microphone collect speech signals simultaneously, consistency between the speech signals collected by the acoustic microphone and the non-acoustic microphone can be improved, which facilitates speech signal processing.

In step S110, speech activity is detected based on the speech signal collected by the non-acoustic microphone, to obtain a result of speech activity detection.

Generally, it is necessary to detect whether there is a speech during a process of speech noise reduction. Accuracy is low when existence of the speech is merely detected based on the speech signal collected by the acoustic microphone in an environment with a low signal-to-noise ratio. In order to improve the accuracy to detect whether or not the speech exits, speech activity is detected based on the speech signal collected by the non-acoustic microphone in this embodiment, thereby reducing an influence of ambient noise on the detection of whether the speech exists, and improving the accuracy of the detection.

A final result of the speech noise reduction can be improved because the accuracy of detecting the existence of a speech is improved.

In step S120, the speech signal collected by the acoustic microphone is denoised based on the result of speech activity detection, to obtain a denoised speech signal.

The speech signal collected by the acoustic microphone is denoised based on the result of speech activity detection. A noise component in the speech signal collected by the acoustic microphone can be reduced, and thereby a speech component after being denoised is more prominent in the speech signal collected by the acoustic microphone.

In embodiments of the present disclosure, the speech signals simultaneously collected by the acoustic microphone and the non-acoustic microphone are obtained. The non-acoustic microphone is capable of collecting a speech signal in a manner unrelated to ambient noise (for example, by detecting vibration of human skin or vibration of human throat bones). Thereby, speech activity detection based on the speech signal collected by the non-acoustic microphone can be used to reduce an influence of the ambient noise and improve detection accuracy, in comparison with that based on the speech signal collected by the acoustic microphone. The speech signal collected by the acoustic microphone is denoised based on the result of speech activity detection, which is obtained from the speech signal collected by the non-acoustic microphone, thereby enhancing the performance of noise reduction and improving a quality of the denoised speech signal to provide a high-quality speech signal for subsequent application of the speech signal.

According to another embodiment of the present disclosure, the step S110 of detecting speech activity based on the speech signal collected by the non-acoustic microphone to obtain a result of speech activity detection may include following steps A1 and A2.

In step A1, fundamental frequency information of the speech signal collected by the non-acoustic microphone is determined.

The fundamental frequency information of the speech signal collected by the non-acoustic microphone determined in this step may refer to a frequency of a fundamental tone of the speech signal, that is, a frequency of closing the glottis when human speaks.

Generally, a fundamental frequency of a male voice may range from 50 Hz to 250 Hz, and a fundamental frequency of a female voice may range from 120 Hz to 500 Hz. A non-acoustic microphone is capable to collect a speech signal with a frequency lower than 2000 Hz. Thereby, complete fundamental frequency information may be determined from the speech signal collected by the non-acoustic microphone.

Figure 2:
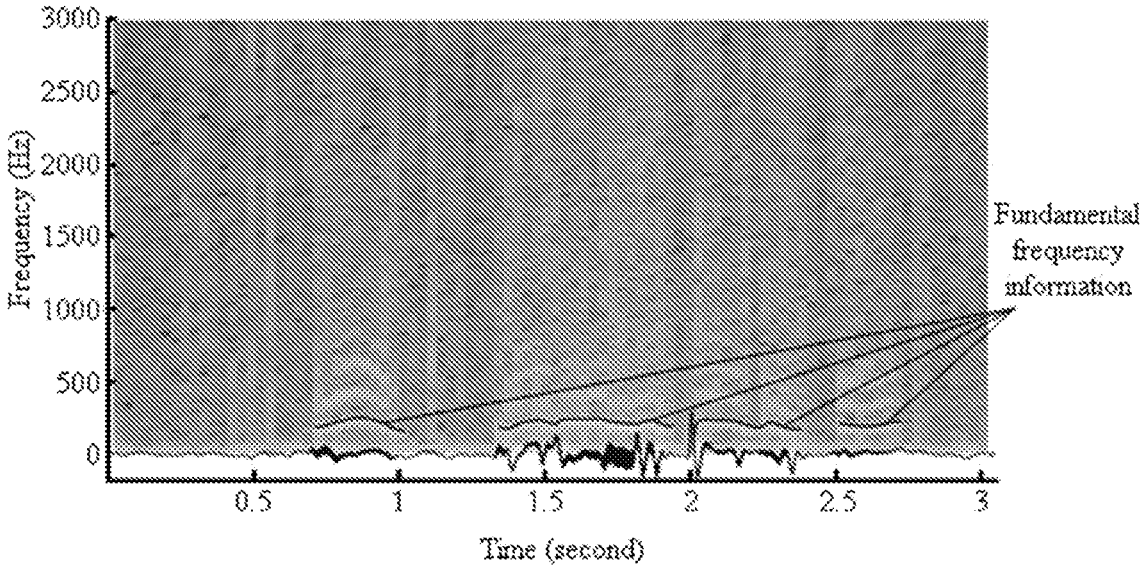
FIG. 2 is a schematic diagram of distribution of fundamental frequency information of a speech signal collected by a non-acoustic microphone.

A speech signal collected by an optical microphone is taken as an example, to illustrate distribution of determined fundamental frequency information in the speech signal collected by the non-acoustic microphone, with reference to FIG. 2. As shown in FIG. 2, the fundamental frequency information is the portion with a frequency between 50 Hz to 500 Hz.

In step A2, the speech activity is detected based on the fundamental frequency information, to obtain the result of speech activity detection.

The fundamental frequency information is audio information that is relatively easy to perceive in the speech signal collected by the non-acoustic microphone. Hence, the speech activity may be detected based on the fundamental frequency information of the speech signal collected by the non-acoustic microphone in this embodiment, realizing the detection of whether the speech exists, reducing the influence of the ambient noise on the detection, and improving the accuracy of the detection.

The speech activity detection may be implemented in various manners. Specific implementations may include, but are not limited to: speech activity detection at a frame level, speech activity detection at a frequency level, or speech activity detection by a combination of a frame level and a frequency level.

In addition, the step S120 may be implemented in different manners which correspond to those for implementing the speech activity detection.

Hereinafter implementations of detecting the speech activity based on the fundamental frequency information and implementations of the corresponding step 120 are introduced based on the implementations of the speech activity detection.

Figure 3:
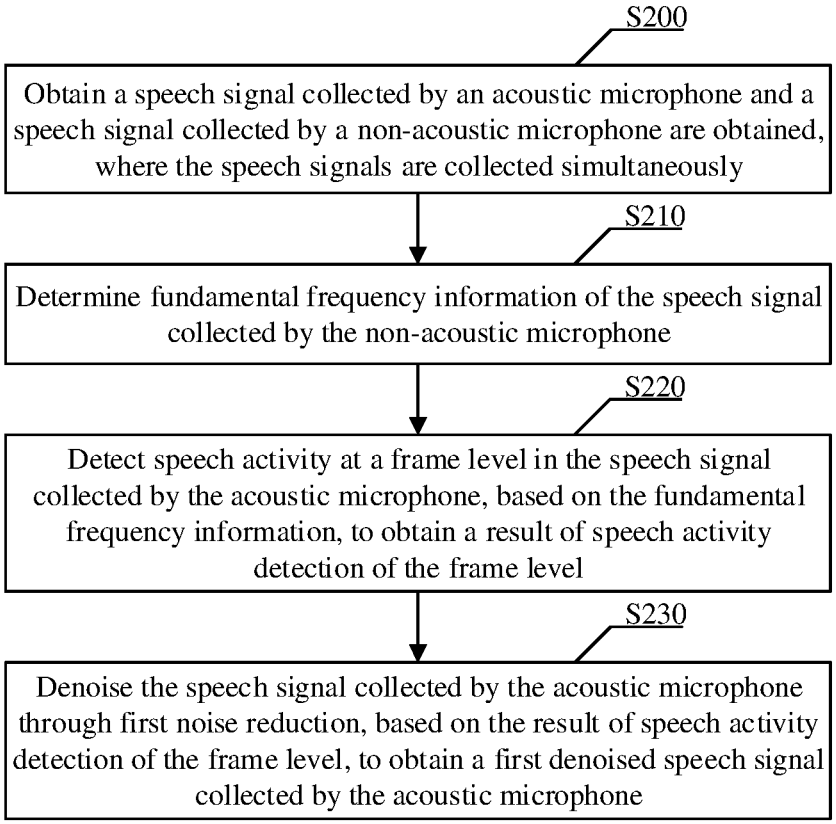
FIG. 3 is a flow chart of a method for speech noise reduction according to another embodiment of the present disclosure.

In one embodiment, a method for speech noise reduction corresponding to the speech activity detection of the frame level is introduced. Referring to FIG. 3, the method may include steps S200 to S230.

In step S200, a speech signal collected by an acoustic microphone and a speech signal collected by a non-acoustic microphone are obtained, where the speech signals are collected simultaneously.

The step S200 is the same as the step S100 in the aforementioned embodiment. A detailed process of the step S200 may refer to the description of the step S100 in the aforementioned embodiment, and is not described again herein.

In step S210, fundamental frequency information of the speech signal collected by the non-acoustic microphone is determined.

The step S210 is same as the step A1 in the aforementioned embodiment. A detailed process of the step S210 may refer to the description of the step A1 in the aforementioned embodiment, and is not described again herein.

In step S220, the speech activity is detected at a frame level in the speech signal collected by the acoustic microphone, based on the fundamental frequency information, to obtain a result of speech activity detection at the frame level.

The step S220 is one implementation of the step A2.

In a specific embodiment, the step S220 may include following steps B1 to B4.

In step B1, it is determined whether or not fundamental frequency information is nonexistent.

In a case that there is fundamental frequency information, the method goes to step B2. In a case that there is no fundamental frequency information, the method goes to step B3.

In step B2, it is determined that there is a voice signal in a speech frame corresponding to the fundamental frequency information, where the speech frame is in the speech signal collected by the acoustic microphone.

In step B3, a signal intensity of the speech signal collected by the acoustic microphone is detected.

In a case that the detected signal intensity of the speech signal collected by the acoustic microphone is small, the method goes to step B4.

In step B4, it is determined that there is no voice signal in a speech frame corresponding to the fundamental frequency information, where the speech frame is in the speech signal collected by the acoustic microphone.

The signal intensity of the speech signal collected by the acoustic microphone is further detected in response to determining that there is no fundamental frequency information, so as to improve the accuracy of the determination that there is no voice signal in the speech frame corresponding to the fundamental frequency information, in the speech signal collected by the acoustic microphone.

In this embodiment, the fundamental frequency information is derived from the speech signal collected by the non-acoustic microphone, and the non-acoustic microphone is capable to collect a speech signal in a manner independent from ambient noise. It can be detected whether there is a voice signal in the speech frame corresponding to the fundamental frequency information. An influence of the ambient noise on the detection is reduced, and accuracy of the detection is improved.

In step S230, the speech signal collected by the acoustic microphone is denoised through first noise reduction based on the result of speech activity detection of the frame level, to obtain a first denoised speech signal collected by the acoustic microphone.

The step S230 is one implementation of the step A2.

A process of denoising the speech signal collected by the acoustic microphone based on the result of speech activity detection at the frame level is different for a case that the acoustic microphone includes a single acoustic microphone and a case that the acoustic microphone includes an acoustic microphone array.

For the single acoustic microphone, an estimate of a noise spectrum may be updated based on the result of speech activity detection of the frame level. Therefore, a type of noise can be accurately estimated, and the speech signal collected by the acoustic microphone may be denoised based on the updated estimate of the noise spectrum. A process of denoising the speech signal collected by the acoustic microphone based on the updated estimate of the noise spectrum may refer to a process of noise reduction based on an estimate of a noise spectrum in conventional technology, and is not described again herein.

For the acoustic microphone array, a blocking matrix and an adaptive filter for eliminating noise may be updated in a speech noise reduction system of the acoustic microphone array, based on the result of speech activity detection of the frame level. Thereby, the speech signal collected by the acoustic microphone may be denoised based on the updated blocking matrix and the updated adaptive filter for eliminating noise. A process of denoising the speech signal collected by the acoustic microphone based on the updated blocking matrix and the updated adaptive filter for eliminating noise may refer to conventional technology, and is not described again herein.

In this embodiment, the speech activity is detected at the frame level based on the fundamental frequency information in the speech signal collected by the non-acoustic microphone, so as to determine whether or not the speech exits. An influence of the ambient noise on the detection can be reduced, and accuracy of the determination of whether the speech exists can be improved. Based on the improved accuracy, the speech signal collected by the acoustic microphone is denoised through the first noise reduction, based on the result of speech activity detection at the frame level. For the speech signal collected by the acoustic microphone, a noise component can be reduced, and a speech component after the first noise reduction is more prominent.

Figure 4:
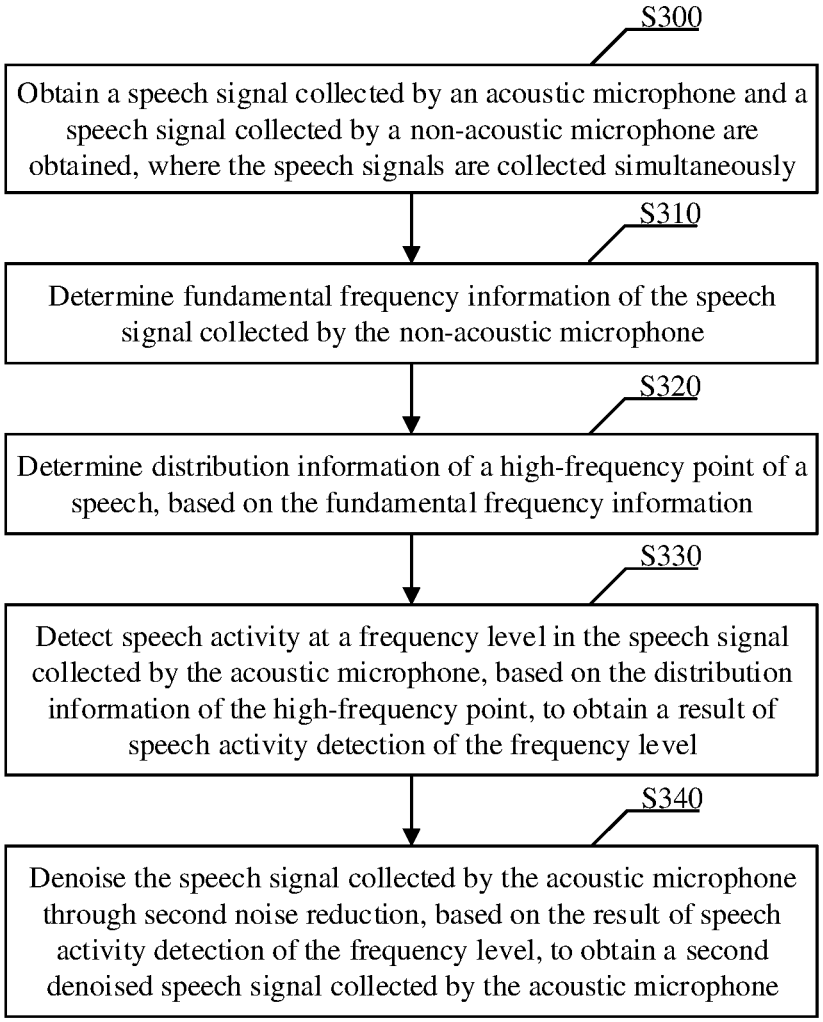
FIG. 4 is a flow chart of a method for speech noise reduction according to another embodiment of the present disclosure.

In another embodiment, a method for speech noise reduction corresponding to the speech activity detection of the frequency level is introduced. Referring to FIG. 4, the method may include steps S300 to S340.

In step S300, a speech signal collected by an acoustic microphone and a speech signal collected by a non-acoustic microphone are obtained, where the speech signals are collected simultaneously.

The step S300 is same as the step S100 in the aforementioned embodiment. A detailed process of the step S300 may refer to the description of the step S100 in the aforementioned embodiment, and is not described again herein.

In step S310, fundamental frequency information of the speech signal collected by the non-acoustic microphone is determined.

The step S310 is same as the step A1 in the aforementioned embodiment. A detailed process of the step S310 may refer to the description of the step A1 in the aforementioned embodiment, and is not described again herein.

In step S320, distribution information of high-frequency points of the speech is determined based on the fundamental frequency information.

The speech signal is a broadband signal, and is sparsely distributed over a frequency spectrum. Namely, some frequency points of a speech frame in the speech signal are the speech component, and some frequency points of the speech frame in the speech signal are the noise component. The speech frequency points may be determined first, so as to better suppress the noise frequency points and retain the speech frequency points. The step S320 may serve as a manner of determining the speech frequency points.

It is understood that the high-frequency points of a speech belong to the speech component, instead of the noise component.

In some application environments (such as a high-noise environment), a signal-to-noise ratio at some frequency points is negative in value, and it is difficult to estimate accurately only using an acoustic microphone whether a frequency point is the speech component or the noise component. Therefore, the speech frequency point is estimated (that is, distribution information of high-frequency points of the speech is determined), based on the fundamental frequency information of the speech signal collected by the non-acoustic microphone according to this embodiment, so as to improve accuracy in estimating the speech frequency points.

In a specific embodiment, the step S320 may include following steps C1 and C2.

In step C1, the fundamental frequency information is multiplied, to obtain multiplied fundamental frequency information.

Multiplying the fundamental frequency information may refer to a following step. The fundamental frequency information is multiplied by a number greater than 1. For example, the fundamental frequency information is multiplied by 2, 3, 4, . . . , N, where N is greater than 1.

In step C2, the multiplied fundamental frequency information is expanded based on a preset frequency expansion value, to obtain a distribution section of the high-frequency points of the speech, where the distribution section serves as the distribution information of the high-frequency points of the speech.

Generally, some residual noise is tolerable, while a loss in the speech component is not acceptable in speech noise reduction. Therefore, the multiplied fundamental frequency information may be expanded based on the preset frequency expansion value, so as to reduce a quantity of high-frequency points that are missed in determination based on the fundamental frequency information, and retain the speech component as many as possible.

In a preferable embodiment, the preset frequency expansion value may be 1 or 2.

In this embodiment, the distribution information of the high-frequency points of the speech may be expressed as $2*f\pm\Delta, 3*f\pm\Delta, \ldots, N*f\pm\Delta$.

where f represents fundamental frequency information, 2*f, 3*f, . . . , and N*f represent The multiplied fundamental frequency information, and A represents the preset frequency expansion value.

In step S330, the speech activity is detected at a frequency level in the speech signal collected by the acoustic microphone, based on the distribution information of the high-frequency points, to obtain a result of speech activity detection at the frequency level.

After the distribution information of high-frequency point of the speech is determined in the step S320, the speech activity may be detected at the frequency level in the speech signal collected by the acoustic microphone, based on the distribution information of the high-frequency points. The high-frequency points of the speech frame are determined as the speech component, and a frequency point other than the high-frequency points of the speech frame is determined as the noise component. On such basis, the step S330 may include a following step.

It is determined, for the speech signal collected by the acoustic microphone, that there is a voice signal at a frequency point in case that the frequency point belongs to the high-frequency points, and there is no voice signal at a frequency point in case that the frequency point does not belong to the high-frequency points.

In step S340, the speech signal collected by the acoustic microphone is denoised through second noise reduction, based on the result of speech activity detection at the frequency level, to obtain a second denoised speech signal collected by the acoustic microphone.

In a specific embodiment, a process of denoising the speech signal collected by a single acoustic microphone or an acoustic microphone array based on the result of speech activity detection at the frequency level may refer to a process of noise reduction based on the result of speech activity detection at the frame level in the step S230 according to the aforementioned embodiment, which is not described again herein.

In this embodiment, the speech signal collected by the acoustic microphone is denoised based on the result of speech activity detection at the frequency level. Such process of noise reduction is referred to as the second noise reduction herein, so as to distinguish such process from the first noise reduction in the aforementioned embodiment.

In this embodiment, the speech activity is detected at the frequency level based on the distribution information of the high-frequency points, so as to determine whether or not the speech exists, to reduce the influence of the ambient noise on the determination, and improve the accuracy of the determination of whether or not the speech exists. Based on the improved accuracy, the speech signal collected by the acoustic microphone is denoised through the second noise reduction, based on the result of speech activity detection of the frequency level. For the speech signal collected by the acoustic microphone, a noise component can be reduced, and a speech component after the second noise reduction is more prominent.

Figure 5:
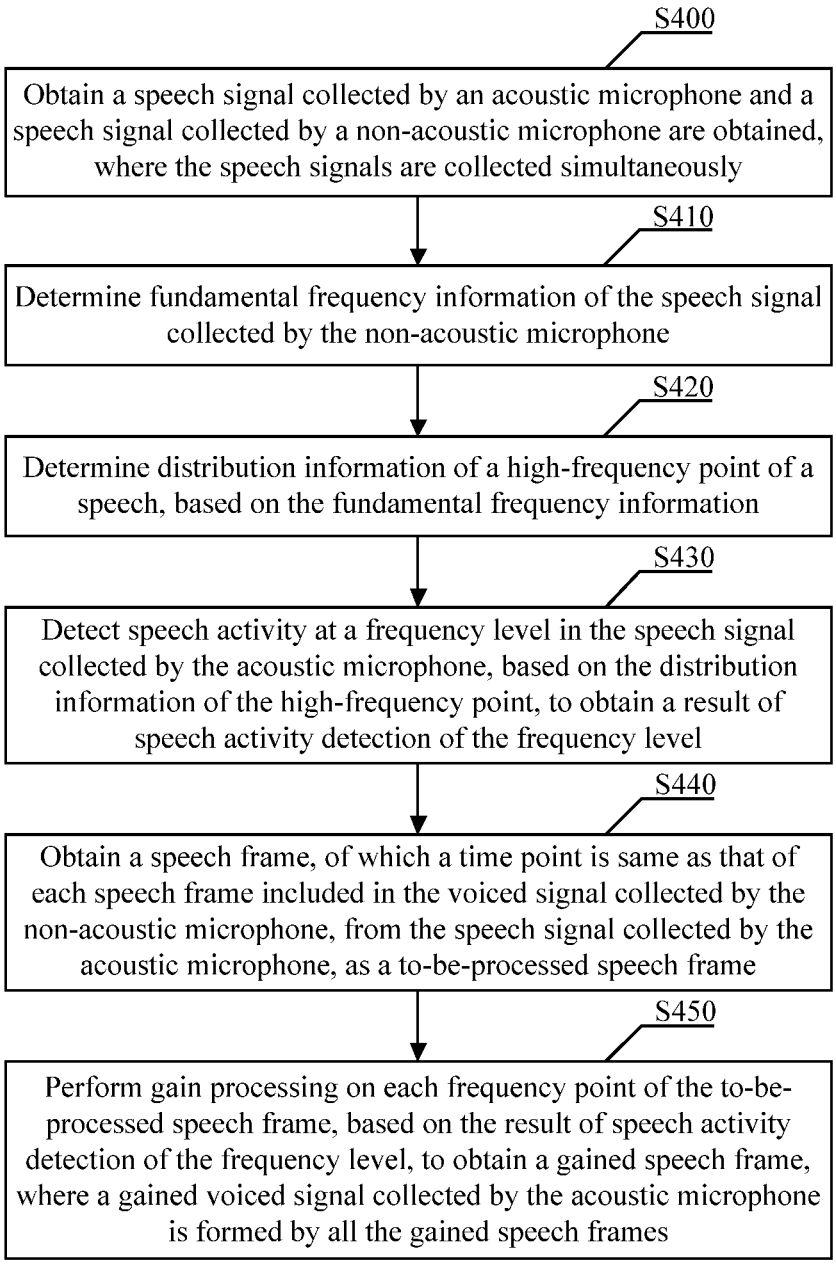
FIG. 5 is a flow chart of a method for speech noise reduction according to another embodiment of the present disclosure.

In another embodiment, another method for speech noise reduction corresponding to the speech activity detection of the frequency level is introduced. Referring to FIG. 5, the method may include steps S400 to S450.

In step S400, a speech signal collected by an acoustic microphone and a speech signal collected by a non-acoustic microphone are obtained, where the speech signals are collected simultaneously.

In a specific embodiment, the speech signal collected by the non-acoustic microphone is a voiced signal.

In step S410, fundamental frequency information of the speech signal collected by the non-acoustic microphone is determined.

The step S410 may be understood to be determining fundamental frequency information of the voiced signal.

In step S420, distribution information of high-frequency points of a speech is determined based on the fundamental frequency information.

In step S430, the speech activity is detected at a frequency level in the speech signal collected by the acoustic microphone, based on the distribution information of the high-frequency points, to obtain a result of speech activity detection of the frequency level.

In step S440, a speech frame in which a time point is the same as that of each speech frame included in the voiced signal collected by the non-acoustic microphone is obtained from the speech signal collected by the acoustic microphone, as a to-be-processed speech frame.

In step S450, gain processing is performed on each frequency point of the to-be-processed speech frame, based on the result of speech activity detection at the frequency level, to obtain a gained speech frame, where a gained voiced signal collected by the acoustic microphone is formed by all the gained speech frames.

A process of the gain processing may include a following step. A first gain is applied to a frequency point in case that the frequency point belongs to the high-frequency points, and a second gain is applied to a frequency point in case that the frequency point does not belong to the high-frequency points, where the first gain is greater than the second gain.

Because the first gain is greater than the second gain and the high-frequency point is the speech component, the first gain is applied to the frequency point being the high-frequency point, and the second gain is applied to the frequency point not being the high-frequency point, so as to enhancing the speech component significantly in comparison with the noise component. The gained speech frames are enhanced speech frames, and the enhanced speech frames form an enhanced voiced signal. Therefore, the speech signal collected by the acoustic microphone is enhanced.

Generally, the first gain value may be 1, and the second gain value may range from 0 to 0.5. In a specific embodiment, the second gain may be selected as any value greater than 0 and less than 0.5.

In one embodiment, in the step of performing the gain processing on each frequency point of the to-be-processed speech frame to obtain the gained speech frame, following equation may be applied for calculation in the gain processing equation.

$$S_{SEi}=S_{Ai}*\mathrm{Comb}_i i=1,2,\ldots,M$$

$S_{SEi}$ and $S_{Ai}$ represent an i-th frequency point in the gained speech frame and the to-be-processed speech frame, respectively, i refers to a frequency point, M represents a total quantity of frequency points in the to-be-processed speech frame.

$Comb_i$ represents a gain, and may be determined by following assignment equation.

$$Comb_i = \begin{cases} G_H & i \in hfp \\ G_{min} & i \notin hfp \end{cases}$$

$G_H$ represents the first gain, f presents the fundamental frequency information, hfp represents the distribution information of high frequency, $i \in hfp$ indicates that the i-th frequency point is the high frequency point, $G_{min}$ represents the second gain, $i \notin hfp$ indicates that the i-th frequency point is not the high frequency point.

In addition, hfp in the assignment equation may be replaced by n*f±Δ to optimize the assignment equation:

$$Comb_i = \begin{cases} G_H & i \in hfp \\ G_{min} & i \notin hfp \end{cases},$$

in an implementation where a distribution section of the high-frequency point may be expressed as 2*f±Δ, 3*f±Δ, N*f±Δ. The optimized assignment equation may be expressed as:

$$Comb_i = \begin{cases} G_H & i \in n*f \pm \Delta \quad n = 1, 2, \ldots, N \\ G_{min} & i \notin n*f \pm \Delta \quad n = 1, 2, \ldots, N \end{cases}$$

In this embodiment, the speech activity is detected at the frequency level based on the distribution information of the high-frequency points, so as to determine whether or not there is the speech. An influence of the ambient noise on the detection can be reduced, and accuracy of detect whether there is the speech can be improved. Based on the improved accuracy, the speech signal collected by the acoustic microphone may be under gain processing (where the gain processing may be treated as a process of noise reduction) based on the result of speech activity detection of the frequency level. For the speech signal collected by the acoustic microphone, a speech component after the gain processing may become more prominent.

Figure 6:
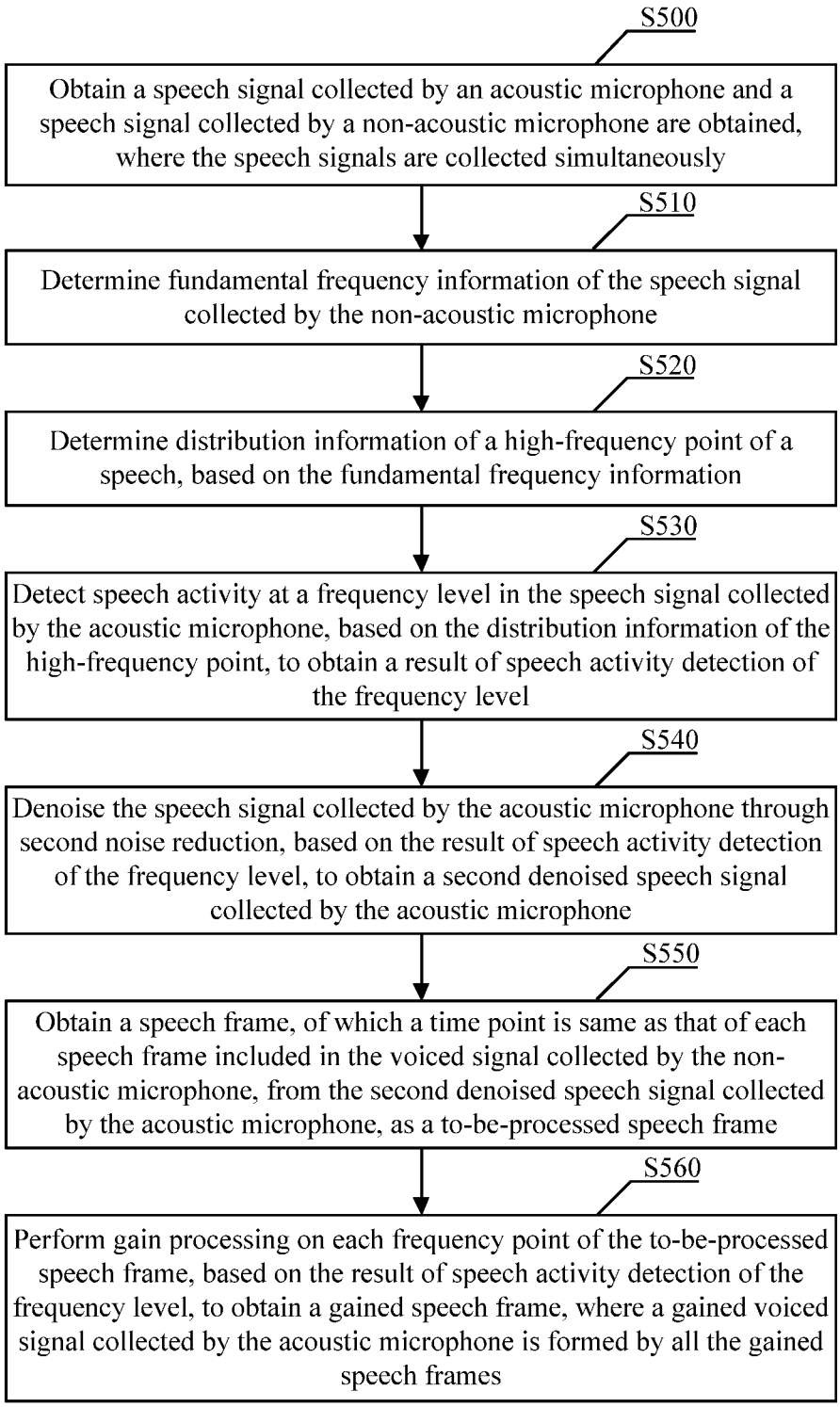
FIG. 6 is a flow chart of a method for speech noise reduction according to another embodiment of the present disclosure.

In another embodiment, another method for speech noise reduction corresponding to the speech activity detection at the frequency level is introduced. Referring to FIG. 6, the method may include steps S500 to S560.

In step S500, a speech signal collected by an acoustic microphone and a speech signal collected by a non-acoustic microphone are obtained, where the speech signals are collected simultaneously.

In a specific embodiment, the speech signal collected by the non-acoustic microphone is a voiced signal.

In step S510, fundamental frequency information of the speech signal collected by the non-acoustic microphone is determined.

The step S510 may be understood to be determining fundamental frequency information of the voiced signal.

In step S520, distribution information of high-frequency points of a speech is determined based on the fundamental frequency information.

In step S530, the speech activity is detected at a frequency level in the speech signal collected by the acoustic microphone, based on the distribution information of the high-frequency point, to obtain a result of speech activity detection at the frequency level.

In step S540, the speech signal collected by the acoustic microphone is denoised through second noise reduction, based on the result of speech activity detection at the frequency level, to obtain a second denoised speech signal collected by the acoustic microphone.

The steps S500 to S540 correspond to steps S300 to S340, respectively, in the aforementioned embodiment. A detailed process of the steps S500 to S540 may refer to the description of the steps S300 to S340 in the aforementioned embodiment, and is not described again herein.

In step S550, a speech frame in which a time point is the same as that of each speech frame included in the voiced signal collected by the non-acoustic microphone is obtained from the second denoised speech signal collected by the acoustic microphone, as a to-be-processed speech frame.

In step S560, gain processing is performed on each frequency point of the to-be-processed speech frame, based on the result of speech activity detection at the frequency level, to obtain a gained speech frame, where a gained voiced signal collected by the acoustic microphone is formed by all the gained speech frames.

A process of the gain processing may include a following step. A first gain is applied to a frequency point in case that the frequency point belongs to the high-frequency points, and a second gain is applied to a frequency point in case that the frequency point does not belong to the high-frequency points, where the first gain is greater than the second gain.

A detailed process of the steps S550 to S560 may refer to the description of the steps S440 to S450 in the aforementioned embodiment, and is not described again herein.

In this embodiment, the second noise reduction is first performed on the speech signal collected by the acoustic microphone, and then the gain processing is performed on the second denoised speech signal collected by the acoustic microphone, so as to further reduce the noise component in the speech signal collected by the acoustic microphone. For the speech signal collected by the acoustic microphone, a speech component after the gain processing becomes more prominent.

Figure 7:
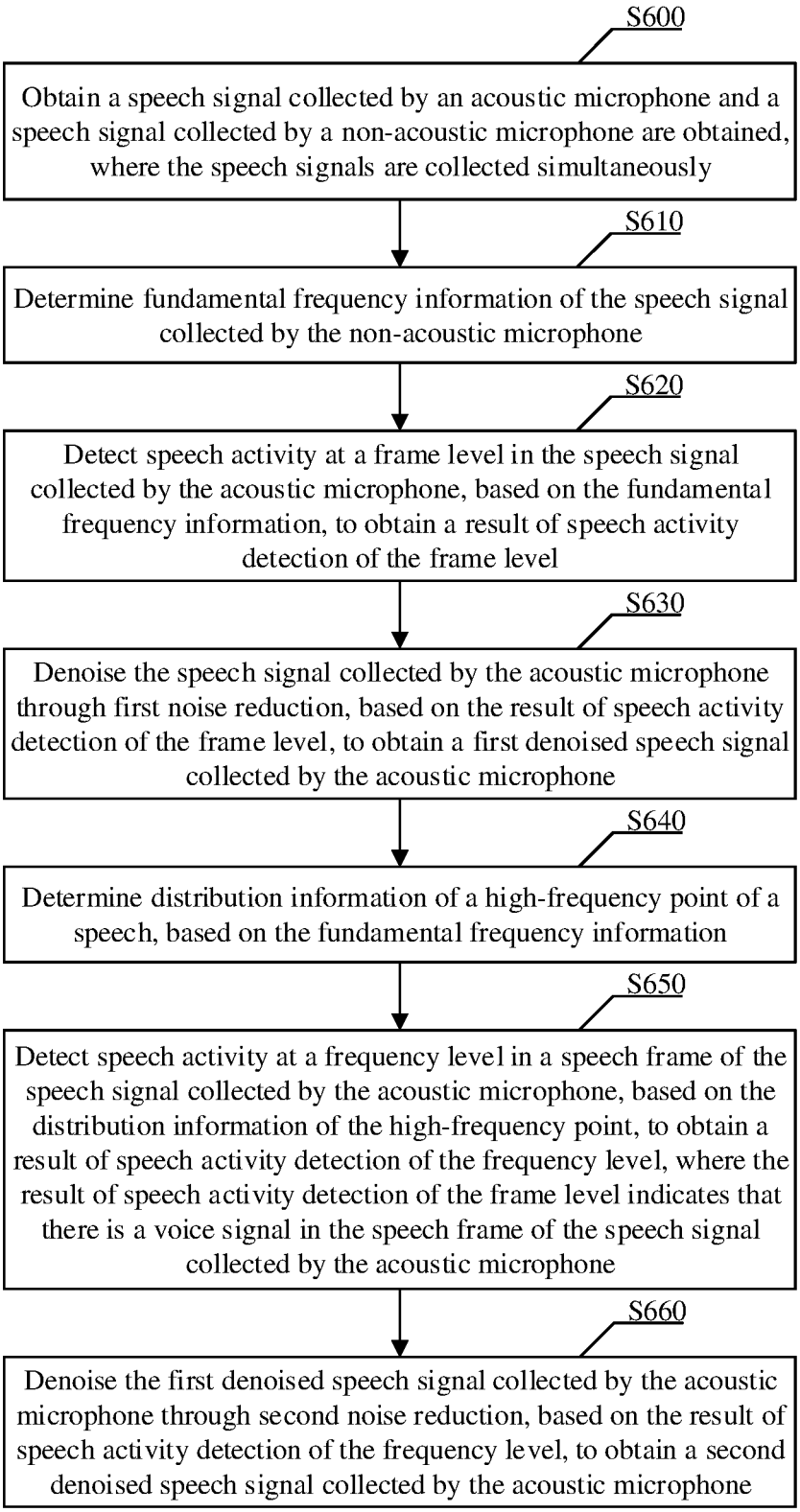
FIG. 7 is a flow chart of a method for speech noise reduction according to another embodiment of the present disclosure.

In another embodiment of the present disclosure, a method for speech noise reduction corresponding to a combination of the speech activity detection of the frame level and the speech activity detection of the frequency level is introduced. Referring to FIG. 7, the method may include steps S600 to S660.

In step S600, a speech signal collected by an acoustic microphone and a speech signal collected by a non-acoustic microphone are obtained, where the speech signals are collected simultaneously.

In step S610, fundamental frequency information of the speech signal collected by the non-acoustic microphone is determined.

In step S620, the speech activity is detected at a frame level in the speech signal collected by the acoustic microphone, based on the fundamental frequency information, to obtain a result of speech activity detection of the frame level.

In step S630, the speech signal collected by the acoustic microphone is denoised through first noise reduction, based on the result of speech activity detection at the frame level, to obtain a first denoised speech signal collected by the acoustic microphone.

The steps S600 to S630 correspond to steps S200 to S230, respectively, in the aforementioned embodiment. A detailed process of the steps S600 to S630 may refer to the description of the steps S200 to S230 in the aforementioned embodiment, and is not described again herein.

In step S640, distribution information of high-frequency points of a speech is determined based on the fundamental frequency information.

A detailed process of the step S640 may refer to the description of the step S320 in the aforementioned embodiment, and is not described again herein.

In step S650, the speech activity is detected at a frequency level in a speech frame of the speech signal collected by the acoustic microphone, based on the distribution information of the high-frequency points, to obtain a result of speech activity detection at the frequency level, where the result of speech activity detection at the frame level indicates that there is a voice signal in the speech frame of the speech signal collected by the acoustic microphone.

In a specific embodiment, the step S650 may include a following step.

It is determined, based on the distribution information of the high-frequency points, that there is the voice signal at a frequency point belonging to a high-frequency point, and there is no voice signal at a frequency point not belonging to the high frequency point, in the speech frame of the speech signal collected by the acoustic microphone, where the result of speech activity detection of the frame level indicates that there is the voice signal in the speech frame.

In step S660, the first denoised speech signal collected by the acoustic microphone is denoised through second noise reduction, based on the result of speech activity detection at the frequency level, to obtain a second denoised speech signal collected by the acoustic microphone.

In this embodiment, the speech signal collected by the acoustic microphone is firstly denoised through the first noise reduction, based on the result of speech activity detection at the frame level. A noise component can be reduced for the speech signal collected by the acoustic microphone. Then, the first denoised speech signal collected by the acoustic microphone is denoised through the second noise reduction, based on the result of speech activity detection at the frequency level. The noise component can be further reduced for the first denoised speech signal collected by the acoustic microphone. For the second denoised speech signal collected by the acoustic microphone, a speech component after the second noise reduction may become more prominent.

Figure 8:
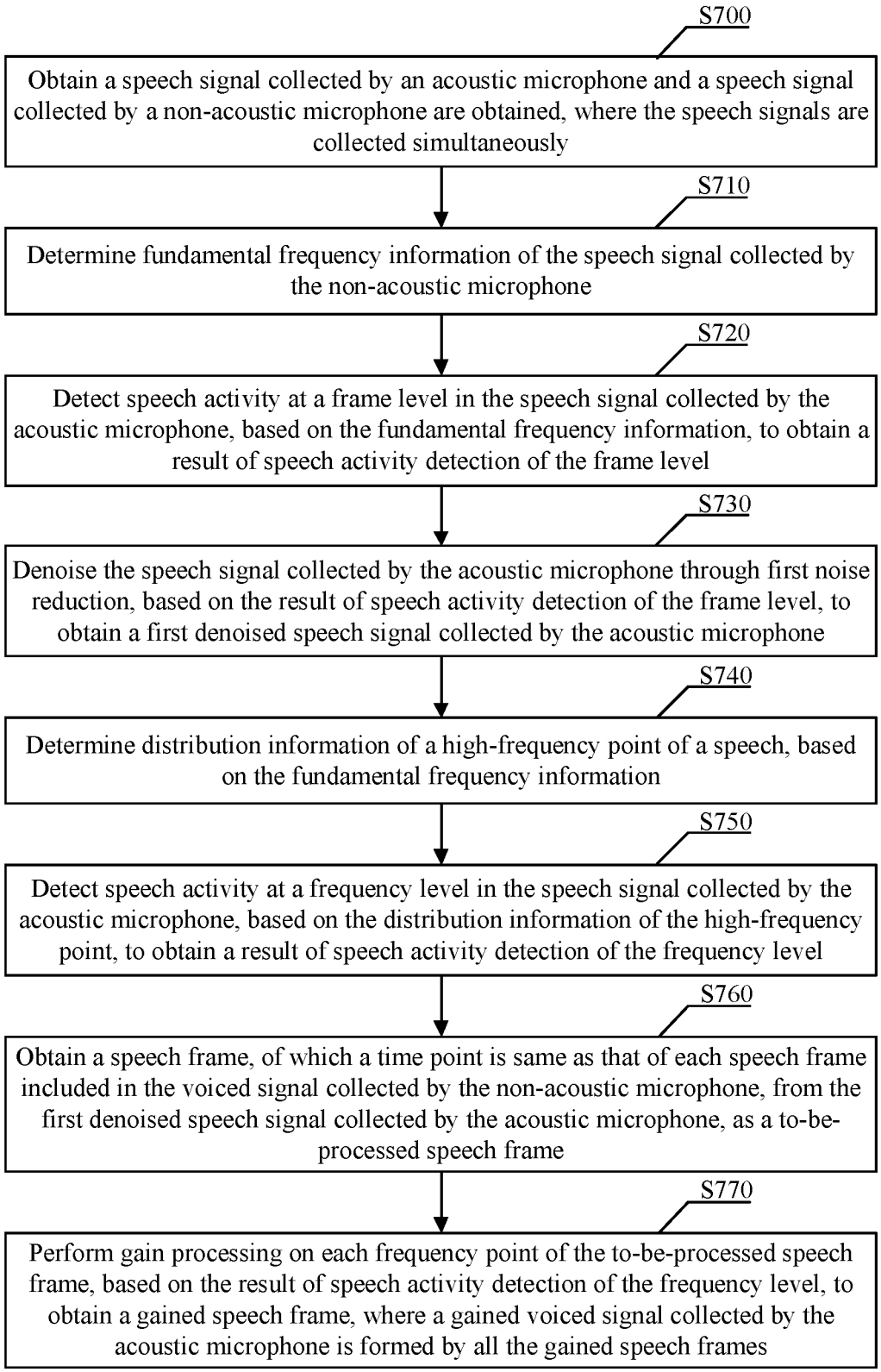
FIG. 8 is a flow chart of a method for speech noise reduction according to another embodiment of the present disclosure.

In another embodiment, another method for speech noise reduction corresponding to a combination of the speech activity detection at the frame level and the speech activity detection at the frequency level is introduced. Referring to FIG. 8, the method may include steps S700 to S770.

In step S700, a speech signal collected by an acoustic microphone and a speech signal collected by a non-acoustic microphone are obtained, where the speech signals are collected simultaneously.

In a specific embodiment, the speech signal collected by the non-acoustic microphone is a voiced signal.

In step S710, fundamental frequency information of the speech signal collected by the non-acoustic microphone is determined.

In step S720, the speech activity is detected at a frame level in the speech signal collected by the acoustic microphone, based on the fundamental frequency information, to obtain a result of speech activity detection of the frame level.

In step S730, the speech signal collected by the acoustic microphone is denoised through first noise reduction, based on the result of speech activity detection at the frame level, to obtain a first denoised speech signal collected by the acoustic microphone.

The steps S700 to S730 correspond to steps S200 to S230, respectively, in the aforementioned embodiment. A detailed process of the steps S700 to S730 may refer to the description of the steps S200 to S230 in the aforementioned embodiment, and is not described again herein.

In step S740, distribution information of high-frequency points of a speech is determined based on the fundamental frequency information.

In step S750, the speech activity is detected at a frequency level in the speech signal collected by the acoustic microphone, based on the distribution information of the high-frequency point, to obtain a result of speech activity detection at the frequency level.

In step S760, a speech frame of which a time point is same as that of each speech frame included in the voiced signal collected by the non-acoustic microphone is obtained from the first denoised speech signal collected by the acoustic microphone, as a to-be-processed speech frame.

In step S770, gain processing is performed on each frequency point of the to-be-processed speech frame, based on the result of speech activity detection at the frequency level, to obtain a gained speech frame, where a gained voiced signal collected by the acoustic microphone is formed by all the gained speech frames.

A process of the gain processing may include a following step. A first gain is applied to a frequency point in case that the frequency point belongs to the high-frequency point, and a second gain is applied to a frequency point in case that the frequency point does not belong to the high-frequency point, where the first gain is greater than the second gain.

A detailed process of the step S770 may refer to the description of the step S450 in the aforementioned embodiment, and is not described again herein.

In this embodiment, firstly the speech signal collected by the acoustic microphone is denoised through the first noise reduction, based on the result of speech activity detection at the frame level. A noise component can be reduced for the speech signal collected by the acoustic microphone. On such basis, the first denoised speech signal collected by the acoustic microphone is gain processed based on the result of speech activity detection at the frequency level. The noise component can be reduced for the first denoised speech signal collected by the acoustic microphone. For the speech signal collected by the acoustic microphone, a speech component after the gain processing may become more prominent.

Figure 9:
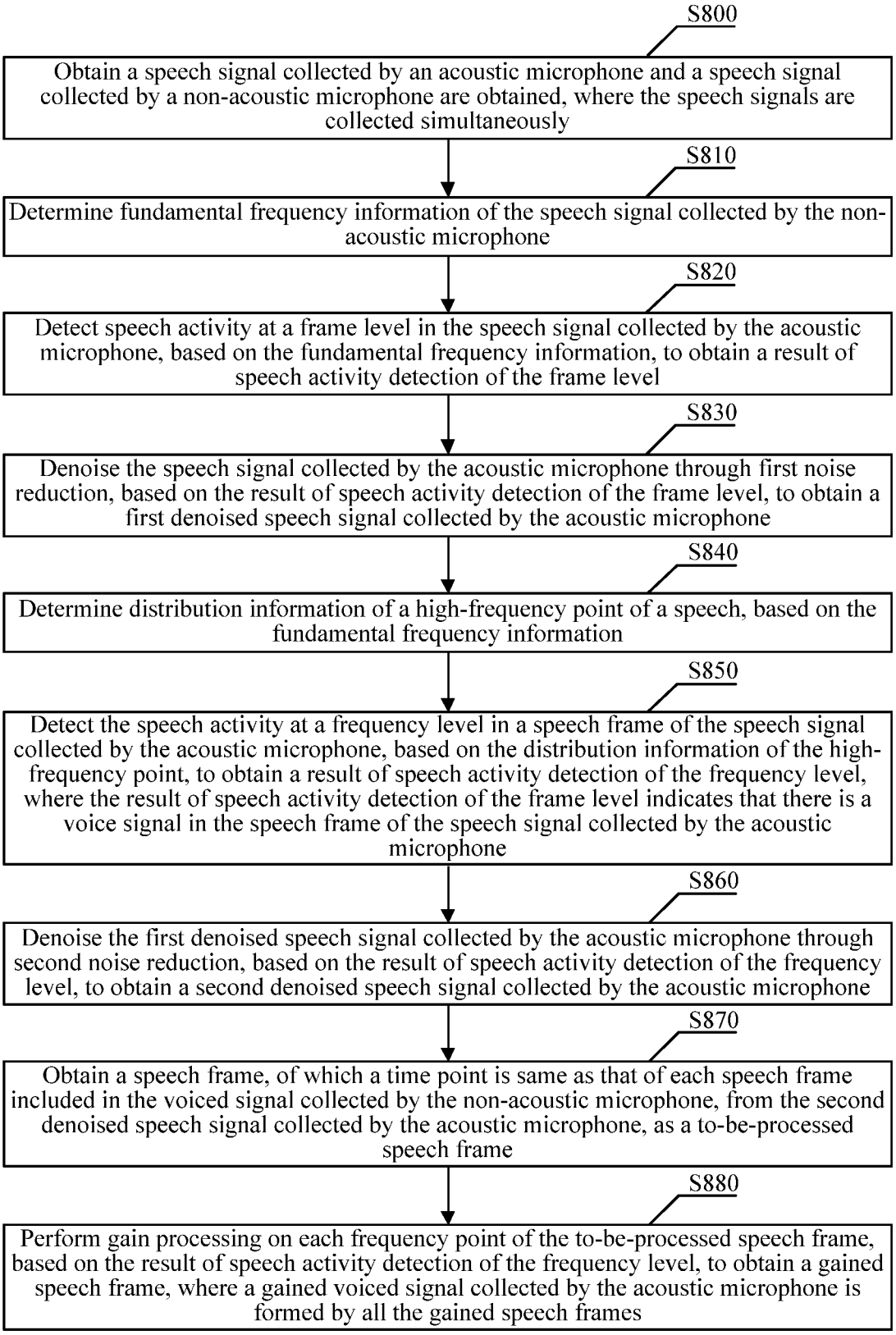
FIG. 9 is a flow chart of a method for speech noise reduction according to another embodiment of the present disclosure.

In another embodiment of the present disclosure, another method for speech noise reduction is introduced on a basis of a combination of the speech activity detection at the frame level and the speech activity detection at the frequency level. Referring to FIG. 9, the method may include steps S800 to S880.

In step S800, a speech signal collected by an acoustic microphone and a speech signal collected by a non-acoustic microphone are obtained, where the speech signals are collected simultaneously.

In a specific embodiment, the speech signal collected by the non-acoustic microphone is a voiced signal.

In step S810, fundamental frequency information of the speech signal collected by the non-acoustic microphone is determined.

In step S820, the speech activity is detected at a frame level in the speech signal collected by the acoustic microphone, based on the fundamental frequency information, to obtain a result of speech activity detection of the frame level.

In step S830, the speech signal collected by the acoustic microphone is denoised through first noise reduction, based on the result of speech activity detection at the frame level, to obtain a first denoised speech signal collected by the acoustic microphone.

In step S840, distribution information of a high-frequency point of a speech is determined based on the fundamental frequency information.

In step S850, the speech activity is detected at a frequency level in a speech frame of the speech signal collected by the acoustic microphone, based on the distribution information of the high-frequency points, to obtain a result of speech activity detection at the frequency level, where the result of speech activity detection of the frame level indicates that there is a voice signal in the speech frame of the speech signal collected by the acoustic microphone.

In step S860, the first denoised speech signal collected by the acoustic microphone is denoised through second noise reduction, based on the result of speech activity detection at the frequency level, to obtain a second denoised speech signal collected by the acoustic microphone.

A detailed process of the steps S800 to S860 may refer to the description of the steps S600 to S660 in the aforementioned embodiment, and is not described again herein.

In step S870, a speech frame in which a time point is the same as that of each speech frame included in the voiced signal collected by the non-acoustic microphone is obtained from the second denoised speech signal collected by the acoustic microphone, as a to-be-processed speech frame.

In step S880, gain processing is performed on each frequency point of the to-be-processed speech frame, based on the result of speech activity detection at the frequency level, to obtain a gained speech frame, where a gained voiced signal collected by the acoustic microphone is formed by all the gained speech frames.

A process of the gain processing may include a following step. A first gain is applied to a frequency point in case that the frequency point belongs to the high-frequency point, and a second gain is applied to a frequency point in case that the frequency point does not belong to the high-frequency point, where the first gain is greater than the second gain.

A detailed process of the step S880 may refer to the description of the step S450 in the aforementioned embodiment, and is not described again herein.

The gain processing may be regarded as a process of noise reduction. Thus, the gained voiced signal collected by the acoustic microphone may be appreciated as a third denoised voiced signal collected by the acoustic microphone.

In this embodiment, firstly the speech signal collected by the acoustic microphone is denoised through the first noise reduction, based on the result of speech activity detection at the frame level. A noise component can be reduced for the speech signal collected by the acoustic microphone. On such basis, the first denoised speech signal collected by the acoustic microphone is denoised through the second noise reduction, based on the result of speech activity detection at the frequency level. A noise component can be reduced for the first denoised speech signal collected by the acoustic microphone. On such basis, the second denoised speech signal collected by the acoustic microphone is gained. The noise component can be reduced for the second denoised speech signal collected by the acoustic microphone. For the speech signal collected by the acoustic microphone, a speech component after the gain processing may become more prominent.

Figure 10:
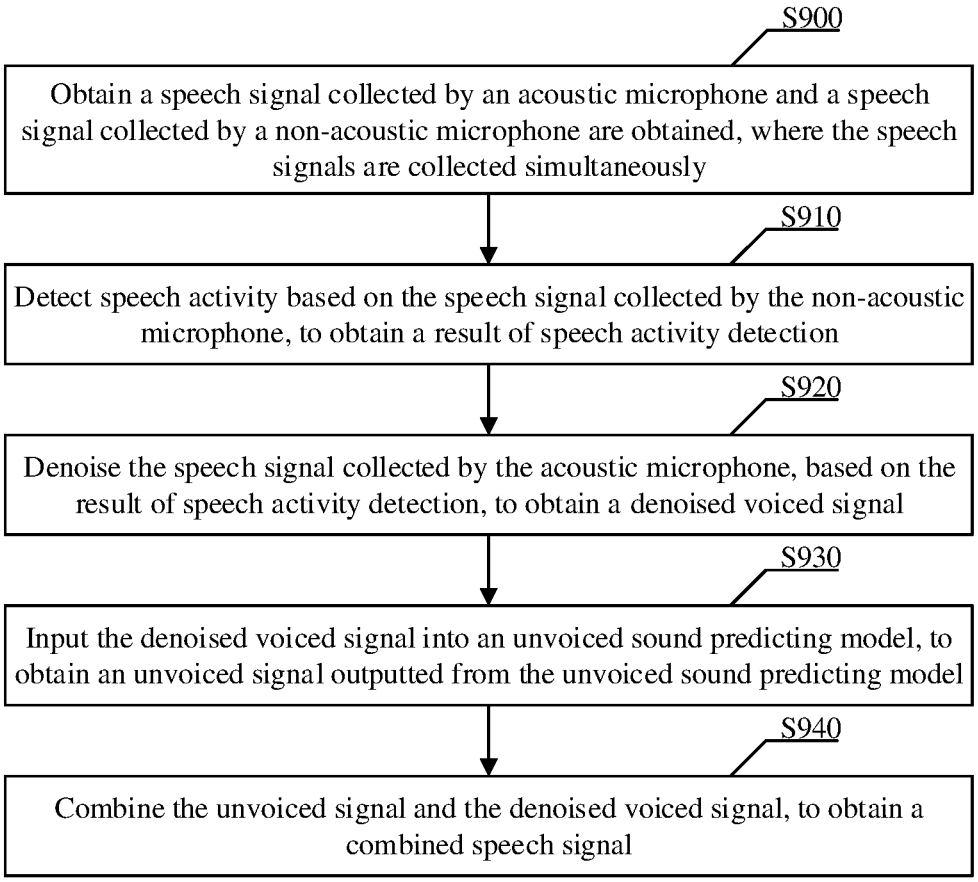
FIG. 10 is a flow chart of a method for speech noise reduction according to another embodiment of the present disclosure.

On a basis of the aforementioned embodiments, a method for speech noise reduction is provided according to another embodiment of the present disclosure. Referring to FIG. 10, the method may include steps S900 to S940.

In step S900, a speech signal collected by an acoustic microphone and a speech signal collected by a non-acoustic microphone are obtained, where the speech signals are collected simultaneously.

In a specific embodiment, the speech signal collected by the non-acoustic microphone is a voiced signal.

In step S910, speech activity is detected based on the speech signal collected by the non-acoustic microphone, to obtain a result of speech activity detection.

In step S920, the speech signal collected by the acoustic microphone is denoised based on the result of speech activity detection, to obtain a denoised voiced signal.

A detailed process of the steps S900 to S920 may refer to the description of related steps in the aforementioned embodiments, which is not described again herein.

In step S930, the denoised voiced signal is inputted into an unvoiced sound predicting model, to obtain an unvoiced signal outputted from the unvoiced sound predicting model.

The unvoiced sound predicting model is obtained by pre-training based on a training speech signal. The training speech signal is marked with a start time and an end time of each unvoiced signal and each voiced signal.

Generally, a speech includes both voiced and unvoiced signals. Therefore, it may need to predict the unvoiced signal in the speech, after obtaining the denoised voiced signal. In a specific embodiment, the unvoiced signal is predicted using the unvoiced sound predicting model.

The unvoiced sound predicting model may be, but is not limited to, a DNN (Deep Neural Network) model.

The unvoiced sound predicting model is pre-trained based on the training speech signal that is marked with a start time and an end time of each unvoiced signal and each voiced signal, thereby ensuring that the trained unvoiced sound predicting model is capable of predicting the unvoiced signal accurately.

In step S940, the unvoiced signal and the denoised voiced signal are combined to obtain a combined speech signal.

A process of combining the unvoiced signal and the denoised voiced signal may refer to a process of combing speech signals in conventional technology. A detailed of combining the unvoiced signal and the denoised voiced signal is not further described herein.

The combined speech signal may be understood as a complete speech signal that includes both the unvoiced signal and the denoised voiced signal.

In another embodiment, a process of training an unvoiced sound predicting model is introduced. In a specific embodiment, the training may include following steps D1 to D3.

In step D1, a training speech signal is obtained.

It is necessary that the training speech signal includes an unvoiced signal and a voiced signal, to ensure accuracy of the training.

In step D2, a start time and an end time of each unvoiced signal and each voiced signal are marked in the training speech signal.

In step D3, the unvoiced sound predicting model is trained based on the training speech signal marked with the start time and the end time of each unvoiced signal and each voiced signal.

The trained unvoiced sound predicting model is the unvoiced sound predicting model used in step S930 in the aforementioned embodiment.

In another embodiment, the obtained training speech signal is introduced. In a specific embodiment, obtaining the training speech signal may include a following step.

A speech signal which meets a predetermined training condition is selected.

The predetermined training condition may include one or both of the following conditions. Distribution of frequency of occurrences of all different phonemes in the speech signal meets a predetermined distribution condition, and/or a type of combinations of different phonemes in the speech signal meets predetermined requirement on the type of combinations.

In a preferable embodiment, the predetermined distribution condition may be a uniform distribution.

Alternatively, the predetermined distribution condition may be that distribution of frequency of occurrences of a majority of phonemes is uniform, and distribution of frequency of occurrences of a minority of phonemes is non-uniform.

In a preferable embodiment, the predetermined requirement on the type of the combination may be including all types of the combination.

Alternatively, the predetermined requirement on the type of the combination may be: including a preset number of types of the combination.

The distribution of frequency of occurrences of all different phonemes in the speech signal meets the predetermined distribution condition, thereby ensuring that the distribution of frequency of occurrences of all different phonemes in the selected speech signal that meets the predetermined training condition is as uniform as possible. The type of the combination of different phonemes in the speech signal meets the predetermined requirement on the type of the combinations, thereby ensuring that the combination of different phonemes in the selected speech signal that meets the predetermined training condition is abundant and comprehensive as much as possible.

The speech signal selected to meet the predetermined training condition may meet a requirement on training accuracy, reduce a data volume of the training speech signal, and improve training efficiency.

On a basis of the aforementioned embodiments, a method for speech noise reduction is further provided according to another embodiment of the present disclosure, in a case that the acoustic microphone includes an acoustic microphone array. The method for speech noise reduction may further include following steps S1 to S3.

In step S1, a spatial section of a speech source is determined based on the speech signal collected by the acoustic microphone array.

In step S2, it is detected whether there is a voice signal in a speech frame in the speech signal collected by the non-acoustic microphone and a speech frame in the speech signal collected by the acoustic microphone, which correspond to a same time point, to obtain a detection result. The speech signals are collected simultaneously.

The detection result can be that there is the voice signal or there is no voice signal, in both the speech frame in the speech signal collected by the non-acoustic microphone and the speech frame in the speech signal collected by the acoustic microphone, which correspond to the same time point.

In step S3, a position of the speech source is determined in the spatial section of the speech source, based on the detection result.

Based on the above detection result in the step S2, it may be determined that there is the voice signal or there is no voice signal in both the speech frame in the speech signal collected by the non-acoustic microphone and the speech frame in the speech signal collected by the acoustic microphone, which correspond to the same time point. Thereby, it is determined that the speech signal collected by the acoustic microphone and the speech signal collected by the non-acoustic microphone are outputted by the same speech source. Further, the position of the speech source can be determined in the spatial section of the speech source, based on the speech signal collected by the non-acoustic microphone.

In a case that multiple people are speaking at the same time, it is difficult to determine the position of a target speech source only based on the speech signal collected by the acoustic microphone array. However, the position of the speech source can be determined with assistance of the speech signal collected by the non-acoustic microphone. A specific implementation is steps S1 to S3 in this embodiment.

Hereinafter an apparatus for speech noise reduction is introduced according to embodiments of the present disclosure. The apparatus for speech noise reduction hereinafter may be considered as a program module that is configured by a server to implement the method for speech noise reduction according to embodiments of the present disclosure. Content of the apparatus for speech noise reduction described hereinafter and the content of the method for speech noise reduction described hereinabove may refer to each other.

Figure 11:
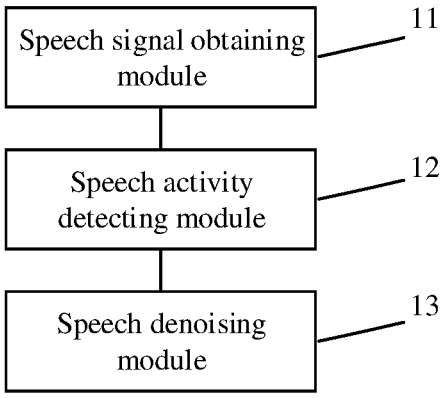
FIG. 11 is a schematic diagram of a logical structure of an apparatus for speech noise reduction according to an embodiment of the present disclosure.

FIG. 11 is a schematic diagram of a logic structure of an apparatus for speech noise reduction according to an embodiment of the present disclosure. The apparatus may be applied to a server. Referring to FIG. 11, the apparatus for speech noise reduction may include: a speech signal obtaining module 11, a speech activity detecting module 12, and a speech denoising module 13.

The speech signal obtaining module 11 is configured to obtain a speech signal collected by an acoustic microphone and a speech signal collected by a non-acoustic microphone, where the speech signals are collected simultaneously.

The speech activity detecting module 12 is configured to detect speech activity based on the speech signal collected by the non-acoustic microphone, to obtain a result of speech activity detection.

The speech denoising module 13 is configured to denoise the speech signal collected by the acoustic microphone, based on the result of speech activity detection, to obtain a denoised speech signal.

In one embodiment, the speech activity detecting module 12 includes a module for fundamental frequency information determination and a submodule for speech activity detection.

The module for fundamental frequency information determination is configured to determine fundamental frequency information of the speech signal collected by the non-acoustic microphone.

The submodule for speech activity detection is configured to detect the speech activity based on the fundamental frequency information, to obtain the result of speech activity detection.

In one embodiment, the submodule for speech activity detection may include a module for frame-level speech activity detection.

The module for frame-level speech activity detection is configured to detect the speech activity at a frame level in the speech signal collected by the acoustic microphone, based on the fundamental frequency information, to obtain a result of speech activity detection of the frame level.

Correspondingly, the speech denoising module may include a first noise reduction module.

The first noise reduction module is configured to denoise the speech signal collected by the acoustic microphone through first noise reduction, based on the result of speech activity detection of the frame level, to obtain a first denoised speech signal collected by the acoustic microphone.

In one embodiment, the apparatus for speech noise reduction may further include: a module for high-frequency point distribution information determination and a module for frequency-level speech activity detection.

The module for high-frequency point distribution information determination is configured to determine distribution information of high-frequency points of a speech, based on the fundamental frequency information.

The module for frequency-level speech activity detection is configured to detect the speech activity at a frequency level in a speech frame of the speech signal collected by the acoustic microphone, based on the distribution information of the high-frequency points, to obtain a result of speech activity detection of the frequency level, where the result of speech activity detection of the frame level indicates that there is a voice signal in the speech frame of the speech signal collected by the acoustic microphone.

Correspondingly, the speech denoising module may further include a second noise reduction module.

The second noise reduction module is configured to denoise the first denoised speech signal collected by the acoustic microphone through second noise reduction, based on the result of speech activity detection at the frequency level, to obtain a second denoised speech signal collected by the acoustic microphone.

In one embodiment, the module for frame-level speech activity detection may include a module for fundamental frequency information detection.

The module for fundamental frequency information detection is configured to detect whether there is no fundamental frequency information.

In a case that there is fundamental frequency information, it is determined that there is a voice signal in a speech frame corresponding to the fundamental frequency information, where the speech frame is in the speech signal collected by the acoustic microphone.

In a case that there is no fundamental frequency information, a signal intensity of the speech signal collected by the acoustic microphone is detected. In a case that the detected signal intensity of the speech signal collected by the acoustic microphone is small, it is determined that there is no voice signal in a speech frame corresponding to the fundamental frequency information, where the speech frame is in the speech signal collected by the acoustic microphone.

In one embodiment, the module for high-frequency point distribution information determination may include: a multiplication module and a module for fundamental frequency information expansion.

The multiplication module is configured to multiply the fundamental frequency information, to obtain multiplied fundamental frequency information.

The module for fundamental frequency information expansion is configured to expand the multiplied fundamental frequency information based on a preset frequency expansion value, to obtain a distribution section of the high-frequency points of the speech, where the distribution section serves as the distribution information of the high-frequency points of the speech.

In one embodiment, the module for frequency-level speech activity detection may include a submodule for frequency-level speech activity detection.

The submodule for frequency-level speech activity detection is configured to determine, based on the distribution information of the high-frequency point, that there is the voice signal at a frequency point belonging to a high-frequency point, and there is no voice signal at a frequency point not belonging to the high frequency point, in the speech frame of the speech signal collected by the acoustic microphone, where the result of speech activity detection of the frame level indicates that there is the voice signal in the speech frame.

In one embodiment, the speech signal collected by the non-acoustic microphone may be a voiced signal.

Based on the speech signal collected by the non-acoustic microphone being a voiced signal, the speech denoising module may further include: a speech frame obtaining module and a gain processing module.

The speech frame obtaining module is configured to obtain a speech frame, in which a time point is the same as that of each speech frame included in the voiced signal collected by the non-acoustic microphone, from the second denoised speech signal collected by the acoustic microphone, as a to-be-processed speech frame.

The gain processing module is configured to perform gain processing on each frequency point of the to-be-processed speech frame to obtain a gained speech frame, where a third denoised voiced signal collected by the acoustic microphone is formed by all the gained speech frames.

A process of the gain processing may include a following step. A first gain is applied to a frequency point in case that the frequency point belongs to the high-frequency point, and a second gain is applied to a frequency point in case that the frequency point does not belong to the high-frequency point, where the first gain is greater than the second gain.

The denoised speech signal may be a denoised voiced signal in the above apparatus. On such basis, the apparatus for speech noise reduction may further include: an unvoiced signal prediction module and a speech signal combination module.

The unvoiced signal prediction module is configured to input the denoised voiced signal into an unvoiced sound predicting model, to obtain an unvoiced signal outputted from the unvoiced sound predicting model. The unvoiced sound predicting model is obtained by pre-training based on a training speech signal. The training speech signal is marked with a start time and an end time of each unvoiced signal and each voiced signal.

The speech signal combination module is configured to combine the unvoiced signal and the denoised voiced signal, to obtain a combined speech signal.

In one embodiment, the apparatus for speech noise reduction may further include a module for unvoiced sound predicting model training.

The module for unvoiced sound predicting model training is configured to: obtain a training speech signal, mark a start time and an end time of each unvoiced signal and each voiced signal in the training speech signal, and train the unvoiced sound predicting model based on the training speech signal marked with the start time and the end time of each unvoiced signal and each voiced signal.

The module for unvoiced sound predicting model training may include a module for training speech signal obtaining.

The module for training speech signal obtaining is configured to select a speech signal which meets a predetermined training condition.

The predetermined training condition may include one or both of the following conditions. Distribution of frequency of occurrences of all different phonemes in the speech signal meets a predetermined distribution condition. A type of a combination of different phonemes in the speech signal meets a predetermined requirement on the type of the combination.

On a basis of the aforementioned embodiments, the apparatus for speech noise reduction may further include a module for speech source position determination, in a case that the acoustic microphone may include an acoustic microphone array.

The module for speech source position determination is configured to: determine a spatial section of a speech source based on the speech signal collected by the acoustic microphone array; detect whether there is a voice signal in a speech frame in the speech signal collected by the non-acoustic microphone and a speech frame in the speech signal collected by the acoustic microphone, which correspond to a same time point, to obtain a detection result; and determine a position of the speech source in the spatial section of the speech source, based on the detection result.

Figure 12:
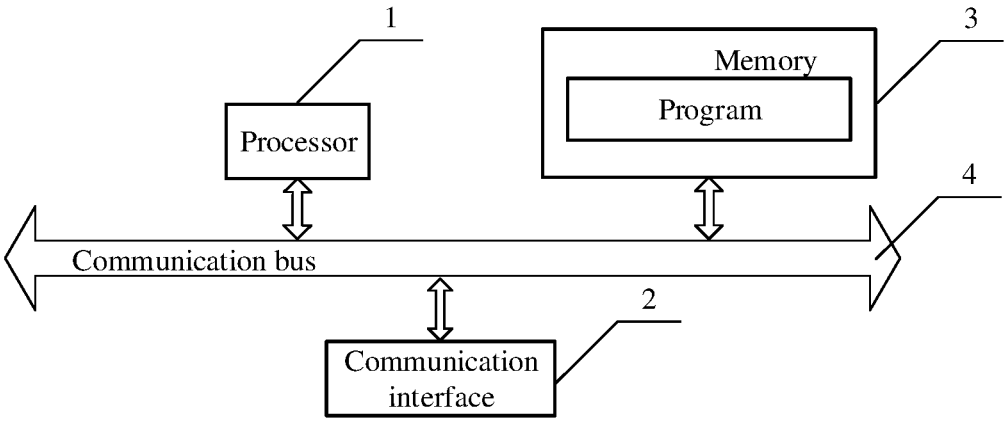
FIG. 12 is a block diagram of a hardware structure of a server.

The apparatus for speech noise reduction according to an embodiment of the present disclosure may be applied to a server, such as a communication server. In one embodiment, a block diagram of a hardware structure of a server is as shown in FIG. 12. Referring to FIG. 12, the hardware structure of the server may include: at least one processor 1, at least one communication interface 2, at least one memory 3, and at least one communication bus 4.

In one embodiment, a quantity of each of the processor 1, the communication interface 2, the memory 3, and the communication bus 4 is at least one. The processor 1, the communication interface 2, and the memory 3 communicate with each other via the communication bus 4.

The processor 1 may be a central processing unit CPU, an application specific integrated circuit (ASIC), or one or more integrated circuits for implementing embodiments of the present disclosure.

The memory 3 may include a high-speed RAM memory, a non-volatile memory, or the like. For example, the memory 3 includes at least one disk memory.

The memory stores a program. The processor executes the program stored in the memory. The program is configured to perform following steps.

A speech signal collected by an acoustic microphone and a speech signal collected by a non-acoustic microphone are obtained, where the speech signals are simultaneously collected.

Speech activity is detected based on the speech signal collected by the non-acoustic microphone, to obtain a result of speech activity detection.

The speech signal collected by the acoustic microphone is denoised based on the result of speech activity detection, to obtain a denoised speech signal.

In an embodiment, refined and expanded functions of the program may refer to the above description.

A storage medium is further provided according to an embodiment of the present disclosure. The storage medium may store a program executable by a processor. The program is configured to perform following steps.

A speech signal collected by an acoustic microphone and a speech signal collected by a non-acoustic microphone are obtained, where the speech signals are simultaneously collected.

Speech activity is detected based on the speech signal collected by the non-acoustic microphone, to obtain a result of speech activity detection.

The speech signal collected by the acoustic microphone is denoised based on the result of speech activity detection, to obtain a denoised speech signal.

In an embodiment, refined and expanded functions of the program may refer to the above description.

In an embodiment, refinement function and expansion function of the program may refer to the description above.

The embodiments of the present disclosure are described in a progressive manner, and each embodiment places emphasis on the difference from other embodiments.

Therefore, one embodiment can refer to other embodiments for the same or similar parts. Since apparatuses disclosed in the embodiments correspond to methods disclosed in the embodiments, the description of apparatuses is simple, and reference may be made to the relevant part of methods.

It should be noted that, the relationship terms such as "first", "second" and the like are only used herein to distinguish one entity or operation from another, rather than to necessitate or imply that an actual relationship or order exists between the entities or operations. Furthermore, the terms such as "include", "comprise" or any other variants thereof means to be non-exclusive. Therefore, a process, a method, an article or a device including a series of elements include not only the disclosed elements but also other elements that are not clearly enumerated, or further include inherent elements of the process, the method, the article or the device. Unless expressively limited, the statement "including a . . . " does not exclude the case that other similar elements may exist in the process, the method, the article or the device other than enumerated elements For the convenience of description, functions are divided into various units and described separately when describing the apparatuses. It is appreciated that the functions of each unit may be implemented in one or more pieces of software and/or hardware when implementing the present disclosure.

From the embodiments described above, those skilled in the art can clearly understand that the present disclosure may be implemented using software plus a necessary universal hardware platform. Based on such understanding, the technical solutions of the present disclosure may be embodied in a form of a computer software product stored in a storage medium, in substance or in a part making a contribution to the conventional technology. The storage medium may be, for example, a ROM/RAM, a magnetic disk, or an optical disk, which includes multiple instructions to enable a computer equipment (such as a personal computer, a server, or a network device) to execute a method according to embodiments or a certain part of the embodiments of the present disclosure.

Hereinafter a method for speech noise reduction, an apparatus for speech noise reduction, a server, and a storage medium according to the present disclosure are introduced in details. Specific embodiments are used herein to illustrate the principle and the embodiments of the present disclosure. The embodiments described above are only intended to help understanding the methods and the core concepts of the present disclosure. Changes may be made to the embodiments and an application range by those skilled in the art based on the concept of the present disclosure. In summary, the specification should not be construed as a limitation to the present disclosure.

The invention claimed is:

1. A method for speech noise reduction, comprising:

obtaining a speech signal collected by an acoustic microphone and a speech signal collected by a non-acoustic microphone, wherein the speech signals are collected simultaneously;

detecting speech activity based on the speech signal collected by the non-acoustic microphone, to obtain a result of speech activity detection; and denoising the speech signal collected by the acoustic microphone, based on the result of speech activity detection, to obtain a denoised speech signal.

2. The method according to claim 1, wherein detecting the speech activity based on the speech signal collected by the non-acoustic microphone to obtain the result of speech activity detection comprises:

determining fundamental frequency information of the speech signal collected by the non-acoustic microphone; and detecting the speech activity based on the fundamental frequency information, to obtain the result of speech activity detection.

3. The method according to claim 2, wherein detecting the speech activity based on the fundamental frequency information to obtain the result of speech activity detection comprises:

detecting the speech activity at a frame level in the speech signal collected by the acoustic microphone, based on the fundamental frequency information, to obtain a result of speech activity detection of the frame level; and wherein denoising the speech signal collected by the acoustic microphone, based on the result of speech activity detection to obtain the denoised speech signal comprises:

denoising the speech signal collected by the acoustic microphone through first noise reduction, based on the result of speech activity detection of the frame level, to obtain a first denoised speech signal collected by the acoustic microphone.

4. The method according to claim 3, wherein detecting the speech activity based on the fundamental frequency information to obtain the result of speech activity detection further comprising:

determining distribution information of a high-frequency point of a speech, based on the fundamental frequency information; and detecting the speech activity at a frequency level in a speech frame of the speech signal collected by the acoustic microphone, based on the distribution information of the high-frequency point, to obtain a result of speech activity detection of the frequency level, wherein the result of speech activity detection of the frame level indicates that there is a voice signal in the speech frame of the speech signal collected by the acoustic microphone; and wherein denoising the speech signal collected by the acoustic microphone based on the result of speech activity detection to obtain the denoised speech signal further comprises:

denoising the first denoised speech signal collected by the acoustic microphone through second noise reduction, based on the result of speech activity detection of the frequency level, to obtain a second denoised speech signal collected by the acoustic microphone.

5. The method according to claim 3, wherein detecting the speech activity at the frame level in the speech signal collected by the acoustic microphone based on the fundamental frequency information to obtain the result of speech activity detection of the frame level comprises:

detecting whether there is no fundamental frequency information;

determining that there is a voice signal in a speech frame corresponding to the fundamental frequency information, in a case that there is fundamental frequency information, wherein the speech frame is in the speech signal collected by the acoustic microphone;

detecting a signal intensity of the speech signal collected by the acoustic microphone is detected, in a case that there is no fundamental frequency information; and determining that there is no voice signal in a speech frame corresponding to the fundamental frequency information, in a case that the detected signal intensity of the speech signal collected by the acoustic microphone is small, wherein the speech frame is in the speech signal collected by the acoustic microphone.

6. The method according to claim 4, wherein determining the distribution information of the high-frequency point of the speech, based on the fundamental frequency information comprises:

multiplying the fundamental frequency information, to obtain multiplied fundamental frequency information; and expanding the multiplied fundamental frequency information based on a preset frequency expansion value, to obtain a distribution section of the high-frequency point of the speech, wherein the distribution section serves as the distribution information of the high-frequency point of the speech.

7. The method according to claim 4, wherein detecting the speech activity at the frequency level in the speech frame of the speech signal collected by the acoustic microphone based on the distribution information of the high-frequency point to obtain the result of speech activity detection of the frequency level comprises:

determining, based on the distribution information of the high-frequency point, that there is the voice signal at a frequency point in case of the frequency point belonging to the high-frequency point, and there is no voice signal at a frequency point not belonging to the high frequency point, in the speech frame of the speech signal collected by the acoustic microphone, wherein the result of speech activity detection of the frame level indicates that there is the voice signal in the speech frame.

8. The method according to claim 4, wherein:

the speech signal collected by the non-acoustic microphone is a voiced signal; and denoising the speech signal collected by the acoustic microphone based on the result of speech activity detection to obtain the denoised speech signal further comprises:

obtaining a speech frame, of which a time point is same as that of each speech frame comprised in the voiced signal collected by the non-acoustic microphone, from the second denoised speech signal collected by the acoustic microphone, as a to-be-processed speech frame; and performing gain processing on each frequency point of the to-be-processed speech frame to obtain a gained speech frame, wherein a third denoised voiced signal collected by the acoustic microphone is formed by all the gained speech frames;

a process of the gain processing comprises:

applying a first gain to a frequency point in case of the frequency point belonging to the high-frequency point, and applying a second gain to a frequency point in case of the frequency point not belonging to the high-frequency point, wherein the first gain value is greater than the second gain value.

9. The method according to claim 1, wherein the denoised speech signal is a denoised voiced signal, and the method further comprises:

inputting the denoised voiced signal into an unvoiced sound predicting model, to obtain an unvoiced signal outputted from the unvoiced sound predicting model, wherein unvoiced sound predicting model is obtained by pre-training based on a training speech signal, and the training speech signal is marked with a start time and an end time of each unvoiced signal and each voiced signal; and combining the unvoiced signal and the denoised voiced signal, to obtain a combined speech signal.

10. An apparatus for speech noise reduction, comprising:

a speech signal obtaining module, configured to obtain a speech signal collected by an acoustic microphone and a speech signal collected by a non-acoustic microphone, wherein the speech signals are collected simultaneously;

a speech activity detecting module, configured to detect speech activity based on the speech signal collected by the non-acoustic microphone, to obtain a result of speech activity detection; and a speech denoising module, configured to denoise the speech signal collected by the acoustic microphone, based on the result of speech activity detection, to obtain a denoised speech signal.

11. The apparatus according to claim 10, wherein the speech activity detecting module comprises:

a module for fundamental frequency information determination, configured to determine fundamental frequency information of the speech signal collected by the non-acoustic microphone; and a submodule for speech activity detection, configured to detect the speech activity based on the fundamental frequency information, to obtain the result of speech activity detection.

12. The apparatus according to claim 11, wherein the submodule for speech activity detection comprises:

a module for frame-level speech activity detection, configured to detect the speech activity at a frame level in the speech signal collected by the acoustic microphone, based on the fundamental frequency information, to obtain a result of speech activity detection of the frame level;

wherein the speech denoising module comprises:

a first noise reduction module, configured to denoise the speech signal collected by the acoustic microphone through first noise reduction, based on the result of speech activity detection of the frame level, to obtain a first denoised speech signal collected by the acoustic microphone.

13. The apparatus according to claim 12, further comprising:

a module for high-frequency point distribution information determination, configured to determine distribution information of a high-frequency point of a speech, based on the fundamental frequency information; and a module for frequency-level speech activity detection, configured to detect the speech activity at a frequency level in a speech frame of the speech signal collected by the acoustic microphone, based on the distribution information of the high-frequency point, to obtain a result of speech activity detection of the frequency level, wherein the result of speech activity detection of the frame level indicates that there is a voice signal in the speech frame of the speech signal collected by the acoustic microphone;

wherein the speech denoising module further comprises:

a second noise reduction module, configured to denoise the first denoised speech signal collected by the acoustic microphone through second noise reduction, based on the result of speech activity detection of the frequency level, to obtain a second denoised speech signal collected by the acoustic microphone.

14. The apparatus according to claim 12, wherein the module for frame-level speech activity detection comprises a module for fundamental frequency information detection, configured to detect whether there is no fundamental frequency information;

it is determined that there is a voice signal in a speech frame corresponding to the fundamental frequency information, in a case that there is fundamental frequency information, wherein the speech frame is in the speech signal collected by the acoustic microphone;

a signal intensity of the speech signal collected by the acoustic microphone is detected, in a case that there is no fundamental frequency information; and it is determined that there is no voice signal in a speech frame corresponding to the fundamental frequency information, in a case that the detected signal intensity of the speech signal collected by the acoustic microphone is small, wherein the speech frame is in the speech signal collected by the acoustic microphone.

15. The apparatus according to claim 13, wherein the module for high-frequency point distribution information determination comprises:

a multiplication module, configured to multiply the fundamental frequency information, to obtain multiplied fundamental frequency information; and a module for fundamental frequency information expansion, configured to expand the multiplied fundamental frequency information based on a preset frequency expansion value, to obtain a distribution section of the high-frequency point of the speech, wherein the distribution section serves as the distribution information of the high-frequency point of the speech.

16. The apparatus according to claim 13, wherein the module for frequency-level speech activity detection comprises:

a submodule for frequency-level speech activity detection, configured to determine, based on the distribution information of the high-frequency point, that there is the voice signal at a frequency point belonging to a high-frequency point and there is no voice signal at a frequency point not belonging to the high frequency point, in the speech frame of the speech signal collected by the acoustic microphone;

wherein the result of speech activity detection of the frame level indicates that there is the voice signal in the speech frame.

17. The apparatus according to claim 13, wherein the speech signal collected by the non-acoustic microphone is a voiced signal;

wherein the speech denoising module further comprises:

a speech frame obtaining module, configured to obtain a speech frame, of which a time point is same as that of each speech frame comprised in the voiced signal collected by the non-acoustic microphone, from the second denoised speech signal collected by the acoustic microphone, as a to-be-processed speech frame; and a gain processing module, configured to perform gain processing on each frequency point of the to-be-processed speech frame to obtain a gained speech frame, wherein a third denoised voiced signal collected by the acoustic microphone is formed by all the gained speech frames; and wherein a process of the gain processing comprises:

applying a first gain to a frequency point in case of the frequency point belonging to the high-frequency point, and applying a second gain to a frequency point in case of the frequency point not belonging to the high-frequency point, wherein the first gain value is greater than the second gain value.

18. The apparatus according to claim 10, wherein the denoised speech signal is a denoised voiced signal, and the apparatus further comprises:

an unvoiced signal prediction module, configured to input the denoised voiced signal into an unvoiced sound predicting model, to obtain an unvoiced signal outputted from the unvoiced sound predicting model, wherein the unvoiced sound predicting model is obtained by pre-training based on a training speech signal, and he training speech signal is marked with a start time and an end time of each unvoiced signal and each voiced signal; and a speech signal combination module, configured to combine the unvoiced signal and the denoised voiced signal, to obtain a combined speech signal.

19. A server, comprising:

at least one memory and at least one processor, wherein the at least one memory stores a program, and the at least one processor invokes the program stored in the memory, wherein the program is configured to perform:

obtaining a speech signal collected by an acoustic microphone and a speech signal collected by a non-acoustic microphone, wherein the speech signals are collected simultaneously;

detecting speech activity based on the speech signal collected by the non-acoustic microphone, to obtain a result of speech activity detection; and denoising the speech signal collected by the acoustic microphone, based on the result of speech activity detection, to obtain a denoised speech signal.

20. A non-transitory storage medium, storing a computer program, wherein the computer program when executed by a processor performs the method for speech noise reduction according to claim 1.

* * * * *